US007350464B2

(12) United States Patent
Riescher et al.

(10) Patent No.: US 7,350,464 B2
(45) Date of Patent: Apr. 1, 2008

(54) MODULAR PRINTING UNIT

(75) Inventors: Georg Riescher, Joessnitz (DE); Josef Hammer, Plauen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/540,138

(22) PCT Filed: Dec. 13, 2003

(86) PCT No.: PCT/EP03/14208

§ 371 (c)(1),
(2), (4) Date: Jun. 21, 2005

(87) PCT Pub. No.: WO2004/056569

PCT Pub. Date: Jul. 8, 2004

(65) Prior Publication Data

US 2006/0081143 A1 Apr. 20, 2006

(30) Foreign Application Priority Data

Dec. 21, 2002 (DE) ..... 102 60 574

(51) Int. Cl.
*B41F 1/34* (2006.01)
*B41F 13/20* (2006.01)

(52) U.S. Cl. ..... 101/480; 101/137; 101/479

(58) Field of Classification Search ..... 101/137, 101/138, 177, 480, 479
See application file for complete search history.

(56) References Cited

U.S. PATENT DOCUMENTS 4,691,631 A * 9/1987 Ishii et al. ..... 101/218
4,831,926 A * 5/1989 Bowman et al. ..... 101/138
5,060,569 A 10/1991 Gladow
5,063,844 A * 11/1991 Fausel ..... 101/247
5,727,465 A 3/1998 Kelm et al.
5,832,821 A 11/1998 Petersen et al.
5,979,316 A 11/1999 Baum
6,085,650 A 7/2000 Petersen
6,397,743 B1 * 6/2002 Dauer et al. ..... 101/220
6,490,973 B1 12/2002 Bösen et al.
6,516,718 B2 * 2/2003 Kamoda et al. ..... 101/335
6,539,857 B1 4/2003 Weschenfelder
6,568,322 B2 * 5/2003 Gottling et al. ..... 101/216
6,883,429 B2 * 4/2005 Kamoda ..... 101/480

FOREIGN PATENT DOCUMENTS

DE 2 130 278 1/1973
DE 43 27 278 A1 2/1995

(Continued)

*Primary Examiner*—Daniel J. Colilla
*Assistant Examiner*—Marissa Ferguson-Samreth
(74) *Attorney, Agent, or Firm*—Cohen Pontani Lieberman & Pavane LLP

(57) ABSTRACT

In order to provide a printing unit (1; 50) of modular design with the lowest possible expenditure on construction and high flexibility, the printing unit (1; 50) of modular design for printing webs (29) has a stand (2; 2'; 54), which is provided with at least one crossmember (3; 4; 51) at both ends (drive and operating side), printing cylinders (9 to 16) being mounted in the crossmembers (3; 4; 51) in such a way that a structural unit comprising crossmembers (3; 4; 51) and printing cylinders (9 to 16) can be taken completely out of and put into the stand (2; 2'; 54).

2 Claims, 5 Drawing Sheets

FOREIGN PATENT DOCUMENTS

| | | | |
|---|---|---|---|
| DE | 195 44 477 | A1 | 6/1997 |
| DE | 198 33 468 | A1 | 1/2000 |
| DE | 199 43 032 | A1 | 5/2000 |
| DE | 199 20 110 | A1 | 11/2000 |
| EP | 1 101 611 | A1 | 5/2001 |
| GB | 1 287 860 | | 9/1972 |
| WO | WO 02/070259 | A1 | 9/2002 |

* cited by examiner

MODULAR PRINTING UNIT

PRIORITY CLAIM

This is a U.S. national stage of application No. PCT/EP2003/014208, filed on 13 Dec. 2003. Priority is claimed on the following application(s): Country: Germany, Application No.: 102 60 574.2, Filed: 21 Dec. 2002.

BACKGROUND OF THE INVENTION

The invention relates to a printing unit for printing webs.

The object of the invention is to provide a printing unit which is designed with the lowest possible expenditure on construction and high flexibility.

SUMMARY OF THE INVENTION

The modular printing unit according to the invention comprises three main groups a frame; subunits; and at least one cross member:

- the frame, performs the load-bearing function and accommodates all the services and operating elements (alternatively a stand configured in the manner of a frame can also be used),
- the format-independent "subunits" are mounted in the frame or stand and which contain the auxiliary subassemblies necessary to the printing process (In the offset process which is common nowadays, the subunits mainly include inking and damping units), and
- the at least one crossmember is configured as a "locking bar", which is arranged in the frame or connected to the stand on both sides and in which the main subassemblies necessary for printing—plate cylinders and rubber-covered cylinders in offset printing—are mounted.

In addition, additional equipment such as plate loading systems or digital imaging systems (direct imaging) can be mounted in the crossmember.

Each crossmember is equipped with one or more swinging arms for what are known as the printing mechanisms, in order to pivot the rubber-covered cylinders.

A great advantage of this system is the independence of the printing process, so that adaptations to the future innovations are possible at any time by replacing the corresponding subassemblies. In addition, the fundamental change or adaptation to other printing processes and to all varieties of offset printing can be covered. By means of the appropriate adaptation of the subunits and/or the crossmember, the printing unit can be extended or converted to anilox, dry offset printing, gravure printing or any printing process developed in the future, with its preconditions.

The modular printing unit of the present invention may be configured as an H printing unit equipped with 1, 2, 3, 4 or more printing points or a modular printing unit configured as an I printing unit with 1, 2 or more printing points. In the I design, imprinting mechanisms may also be installed. The subunits of the modular printing unit are preassembled for this purpose and are attached to the frame.

The ratio of the plate cylinders to rubber-covered cylinders mounted in the crossmember can be x:x or x:y (for y>x), but advantageously 1:1, 1:2 and 2:2. However, 2:3, 3:3 and so on are just as conceivable.

The proportion of the wall for inking and damping units is separate from the proportion of the wall for plate cylinders and rubber-covered cylinders and is called a "subunit" here. The inking units can alternatively contain 1, 2, 3 or 4 and more ink applicator rolls and as many distributor cylinders as desired. The damping units can alternatively contain 1 or 2 damping solution transfer rolls and as many distributor cylinders as desired. Inking and damping units can also be connected to one or more "coupling rolls" for indirect damping.

The rubber-covered cylinder is pivoted out by means of a swinging arm arranged in the crossmember for good accessibility (for example replacement of the rubber-covered cylinder cover, removal of a wrap); the pivot for this purpose is advantageously located at the center of the plate cylinder. Translational movements are not absolutely necessary but there is the possibility of displacing the impression cylinder, rubber-covered cylinder and plate cylinder arranged in the crossmember in the translational direction in relation to one another.

The subunits are designed in a modular way, which are advantageously constructed identically, these primarily accommodating inking and damping units. As a result of the identical structure of the subunits, these can advantageously be given the same dimensions, which improves the replaceability and minimizes the production costs.

From this, in the case of identical subunits, it is possible to derive a) H printing units with identical height and, if appropriate, format-dependent different width with a horizontal crossmember and b) I printing units with identical widths and, if appropriate, format-dependent different height with vertical crossmember.

By means of the combination of a top left and bottom right subunit designed in a modular way, it is possible to construct an I printing unit for a left-right machine; by means of the combination of a top right and bottom left subunit designed in a modular way, it is possible to construct an I printing unit for a right-left machine.

The plate cylinders and rubber-covered cylinders may be arranged in the crossmember in one line parallel to the crossmember, crossed in any direction or arranged at angles to one another.

The modular printing unit can be equipped with various types of drive:

- an H drive for the simultaneous drive of four printing mechanisms, integrated in the frame;
- a bridge drive for the simultaneous drive of two printing mechanisms, integrated in the crossmember, advantageously positioned at the center of the plate cylinder and driving the rubber-covered cylinder via drive elements; or
- an individual drive for each printing mechanism, integrated in the crossmember, advantageously positioned at the center of the plate cylinder and driving the rubber-covered cylinder via drive elements, or integrated in the respective subunit.

In order to throw the print on and off, plate cylinder and rubber-covered cylinder can be moved toward each other via eccentrics.

The frames, crossmembers and swinging arms can be created constructionally simply and, as a result, cost-effectively. For example, the crossmembers can be implemented with commercially available profiles. In addition, the printing units configured by means of the frame, the crossmembers and the swinging arms are distinguished by a reduced-weight, compact and space-saving design.

Thus, using one and the same printing unit, it is possible to print as desired in the gravure printing or offset printing process, it being possible for the machine to be converted simply from one process to the other as a result of the modular design and the replacement of the crossmember fitted with the appropriate cylinders and the replacement of the corresponding modular subunits. In addition, both printing processes can be used simultaneously. Furthermore, for example the one printing process can be used for the recto printing and the other printing process can be used for the verso printing. The press manufacturer can create the machines for both processes identically from the same components, which permits cost-effective fabrication. In addition, the printing devices can be designed with variable format, that is to say they can be converted simply to other formats, i.e. other diameters of the printing mechanism cylinders and section lengths. Moreover, the printing unit can be changed over quickly to different production variants. Furthermore, the printing unit can also be converted to a varnishing unit or at least as a varnishing mechanism for recto printing or for verso printing.

It is significant that a printing unit of modular design is provided for printing webs, which has a stand which is provided with at least one crossmember at both ends (drive side and operating side), printing cylinders being mounted in the crossmembers in such a way that a structural unit comprising crossmembers and printing cylinders can be taken completely out of and put into the stand.

BRIEF DESCRIPTION OF THE DRAWINGS

In the drawings, wherein like reference characters denote similar elements throughout the several views.

DETAILED DESCRIPTION OF THE PREFERRED EMBODIMENTS

Figure 1:
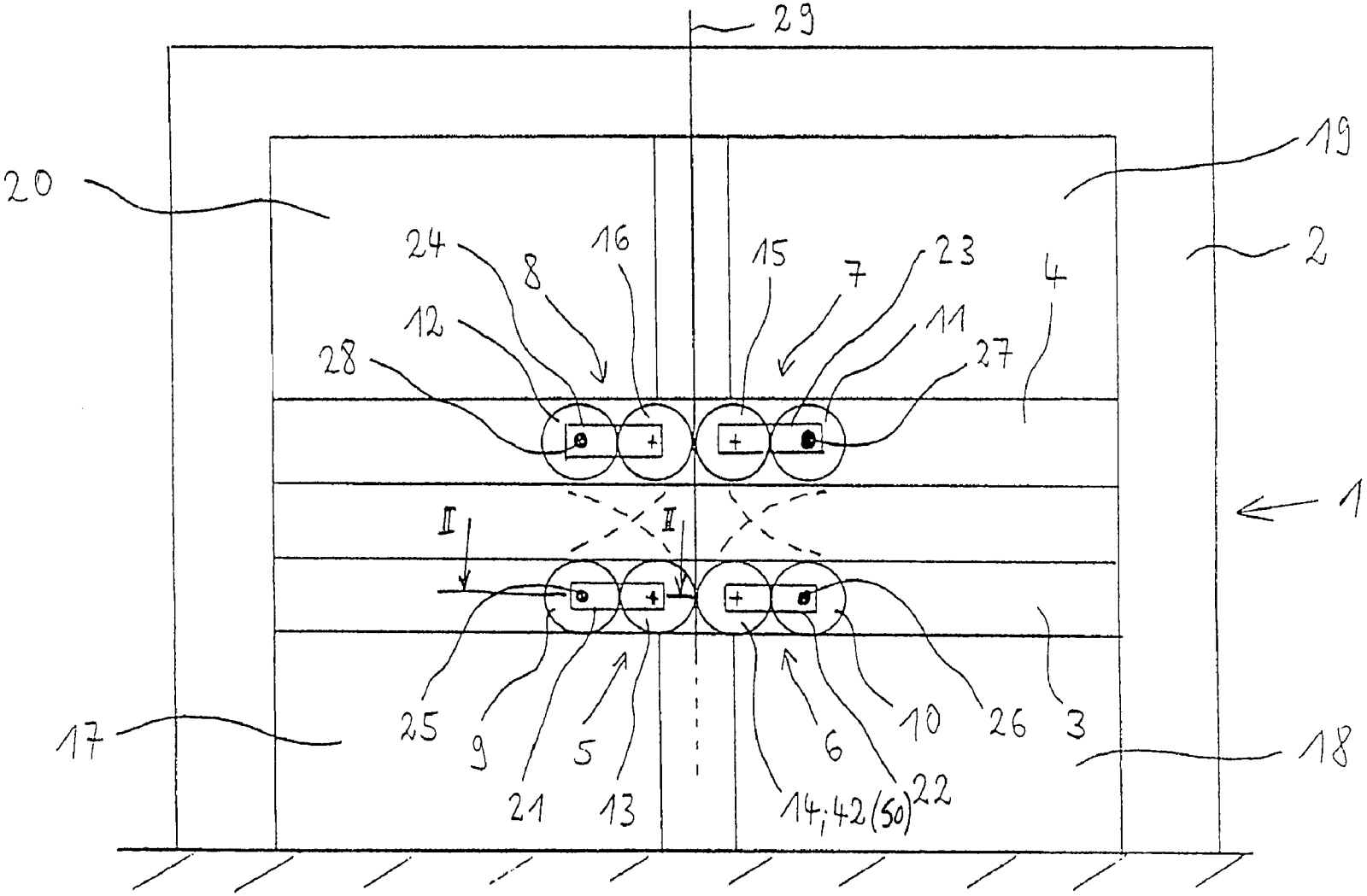
FIG. 1 is a schematic side view of a printing unit according to the invention, configured as an H printing unit having four printing points.

FIG. 1 shows a printing unit 1 of a web-fed rotary press, comprising a stand 2 constructed in the manner of a frame. Two crossmembers 3; 4 are connected to the latter on both sides (only one side is shown in FIG. 1), in each case two printing mechanisms 5 to 8 having plate cylinders 9 to 12 and rubber-covered cylinders 13 to 16 being arranged in the crossmembers 3; 4 and the crossmembers 3; 4 being arranged horizontally in the stand 2. The plate cylinders 9 to 12 and the rubber-covered cylinders 13 to 16 are here arranged in line in the crossmember 3; 4. They can be arranged in the crossmember 3; 4 crossed in any direction or at angles to one another, not illustrated here. Each printing mechanism 5 to 8 or each plate cylinder 9 to 12 is connected to a subunit 17 to 20 of modular design, the subunit 17 to 20 being arranged between the respective crossmember 3; 4 and the stand 2. Inking and damping units, not specifically illustrated, are integrated in the subunits 17 to 20.

The printing unit 1 equipped with four printing mechanisms 5 to 8 in this way represents what is known as an H printing unit with four printing points. A web 29 to be printed is led through between the rubber-covered cylinders 13 to 16. The printing mechanisms 5 to 8 print the web 29 on both sides.

The rubber-covered cylinder 13; to 16 can be configured as an impression cylinder 50, the respective form cylinder 9 to 12 belonging to the rubber-covered cylinder 13 to 16 now designed as an impression cylinder 42 being omitted. When impression cylinder 50 is used, the web 29 is thus printed on one side.

The respective rubber-covered cylinder 13 to 16 can be pivoted on the crossmember 3; 4 by means of a swinging arm 21 to 24, the pivot of the swinging arm 21 to 24 preferably being an axle 25 to 28 of the respective plate cylinder 9 to 12. The crossmember 3; 4 is screwed to the stand 2 on both sides (not specifically illustrated), so that, for example, replacement of the respective printing mechanisms 5 to 8 can be effected quickly.

The crossmember 3; 4 consists, for example, of sheet metal turned over at the edge or sheet metal profiles. The printing cylinders 9 to 16 can be moved in relation to each other via bearing points configured as eccentrics in order to throw the print on/off.

Figure 2:
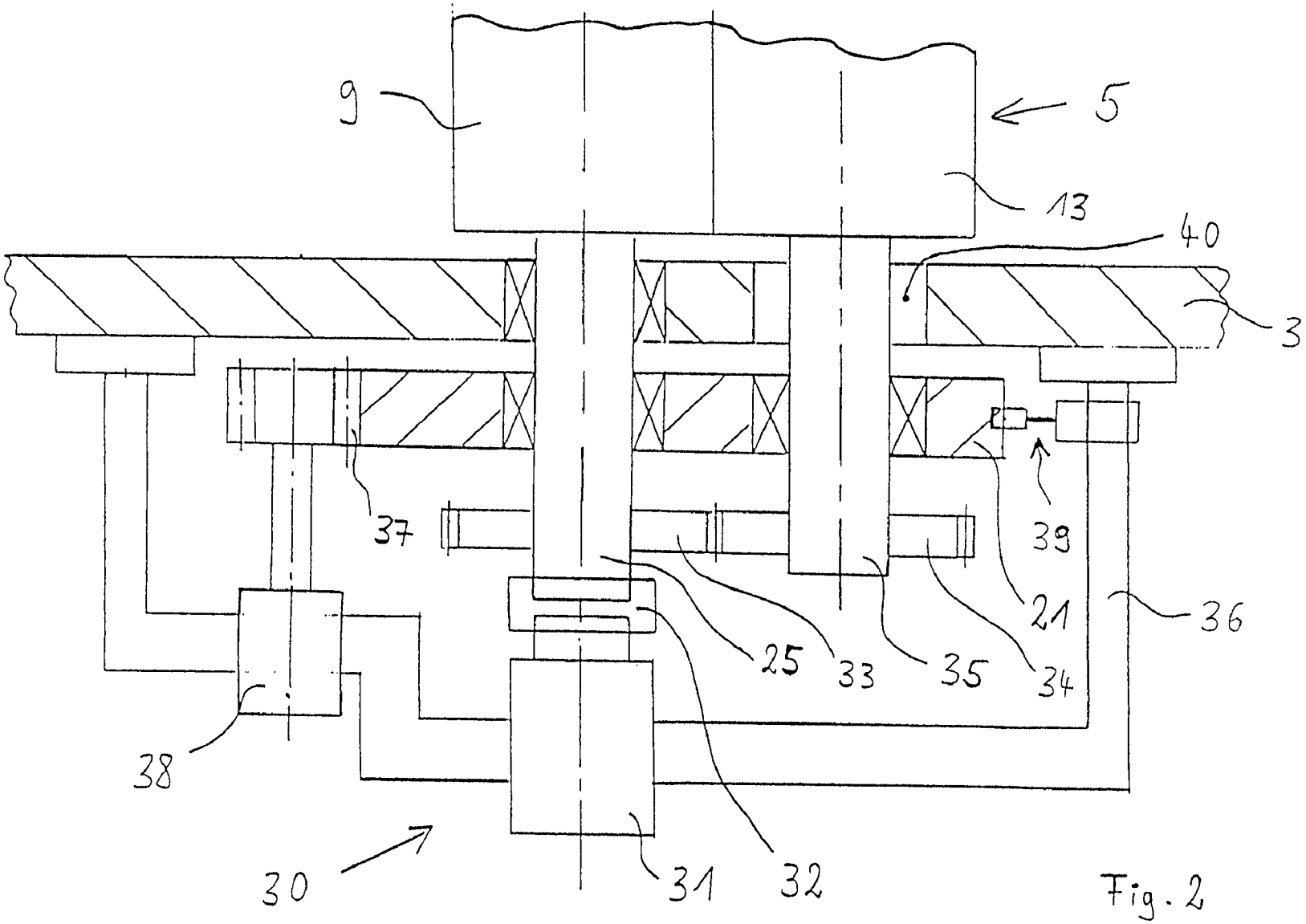
FIG. 2 is a sectional plan view of a drive of a printing mechanism according to FIG. 1.

FIG. 2 shows a drive 30 of the printing mechanism 5. The drive 30 comprises a drive motor 31 which has a drive connection to the plate cylinder 9 via a clutch 32. The plate cylinder 9 is connected to the rubber-covered cylinder 13 via gears 33; 34 arranged on their axles 25; 35. The drive motor 31 is arranged on a bracket 36 connected to the crossmember 3. Mounted on the axle 25 of the plate cylinder 9 is the swinging arm 21, which can be pivoted about the axle 25 by means of a pivoting motor 38 which is fixed to the bracket 36 and engages with a toothed segment 37 arranged on the winging arm 21. Before the pivoting action, a locking device 39 has to be released which, during printing operation, connects the swinging arm 21 to the bracket 36 in a locking manner. It is self-evident that the crossmember 3 is equipped with a cutout 40 along the pivoting travel of the axle 35 of the rubber-covered cylinder 13. Although not specifically illustrated, the swinging arm 21 can also be pivoted by means of an operating cylinder operated by pressure medium instead of by means of the pivoting motor.

Figure 3:
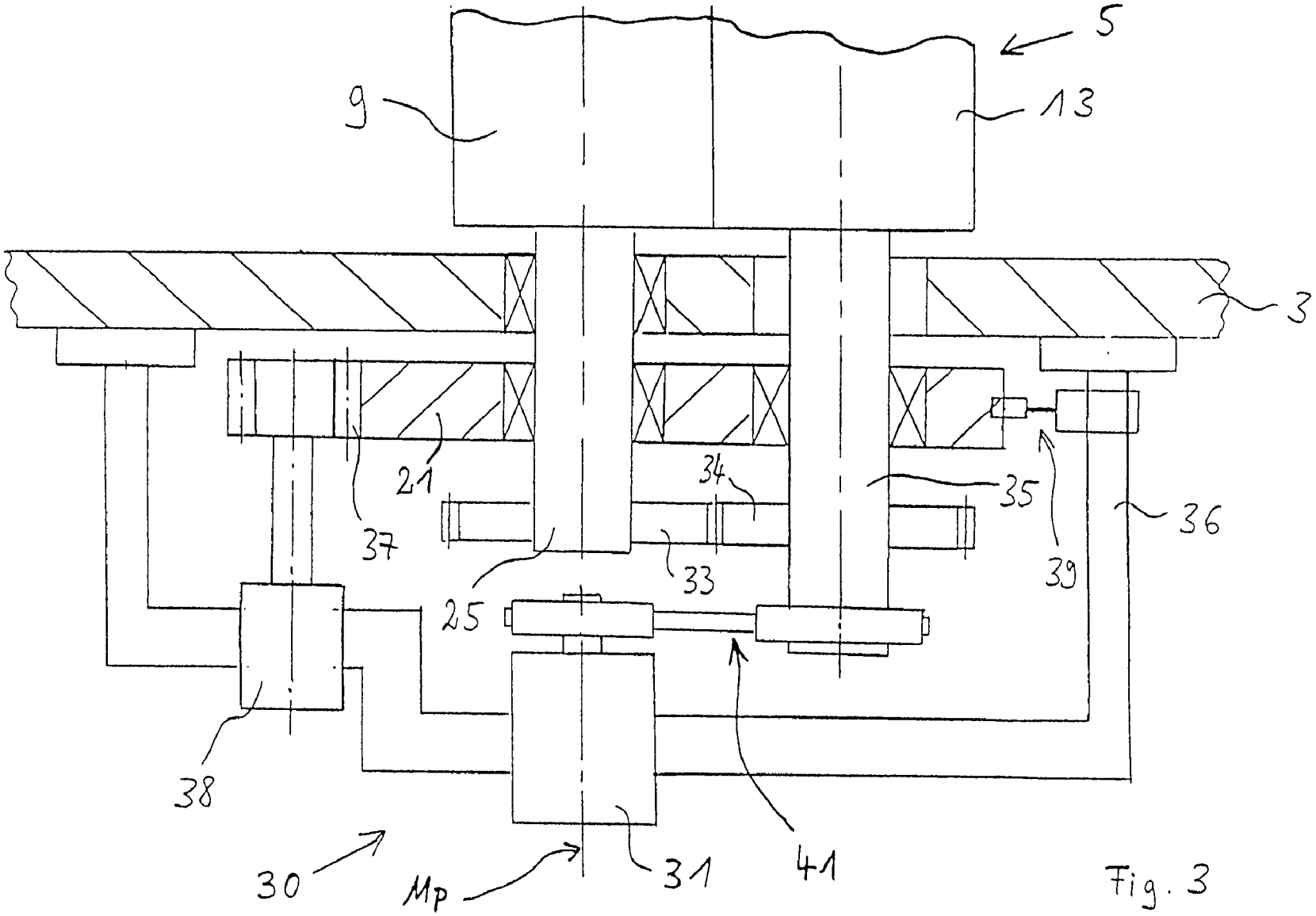
FIG. 3 is a sectional plan view of a further drive of a printing mechanism according to FIG. 1, FIGS. 4*a* and 4*b* are side views of a printing unit according to the invention configured as an I printing unit.

FIG. 3 shows a variant of FIG. 2. Here, the drive motor 31 drives the rubber-covered cylinder 13 for example via a drive element 41, for example a toothed belt. In a manner analogous to FIG. 2, the drive motor 31 is located in its position at the center $M_p$ of the plate cylinder 9, in order that it does not change its position when the rubber-covered cylinder 13 is pivoted out.

Figure 4A:
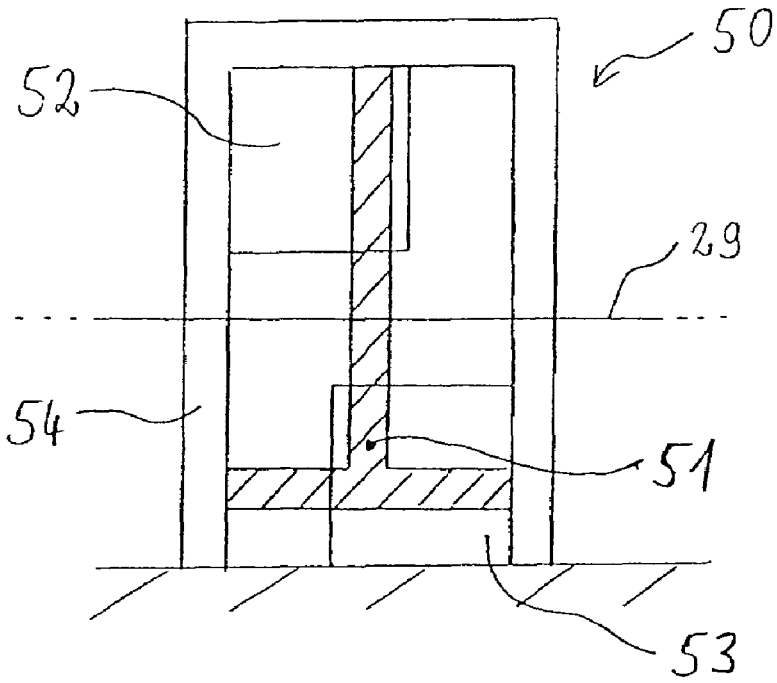
Figure 4B:
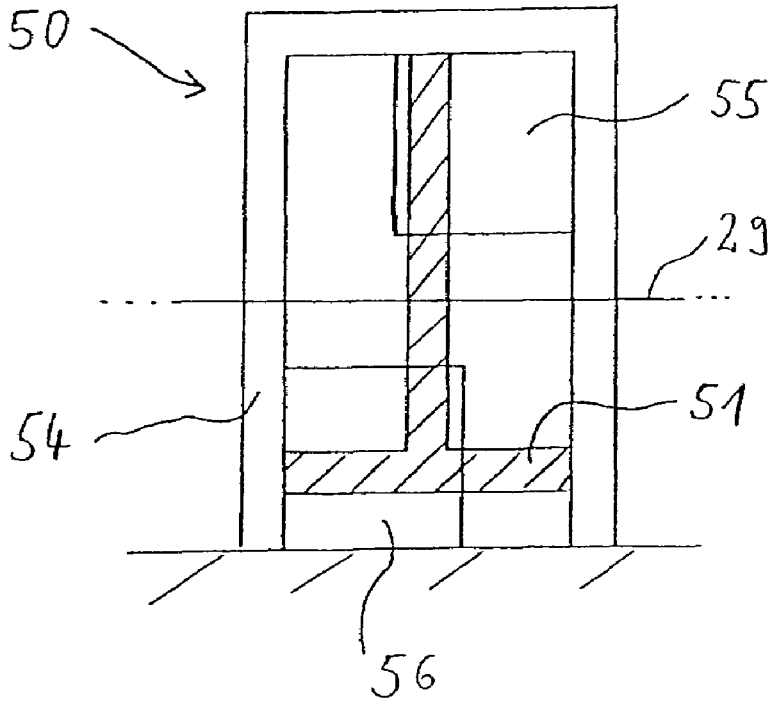

FIGS. 4A and 4B a printing unit 50 which is configured as an I printing unit. In an I printing unit 50, the crossmember 51 is, for example, configured in the shape of a T and the web 29 is led through the printing unit 50 in the horizontal direction. The I printing unit 50 can be equipped with 1 or 2 printing points. Thus, imprinting mechanisms can also be incorporated in an I design. The subunits 52; 53 are preassembled in a way analogous to FIG. 1 for this purpose and are fitted in the stand 54.

By means of the combination of a top left 52 and bottom right subunit 53 designed in a modular way, it is possible to construct an I printing unit 50 for a left-right machine (see FIG. 4A); by means of the combination of a top right 55 and bottom left subunit 56 designed in a modular way, it is possible to construct an I printing unit 50 for a right-left machine (see FIG. 4B).

Figure 5A:
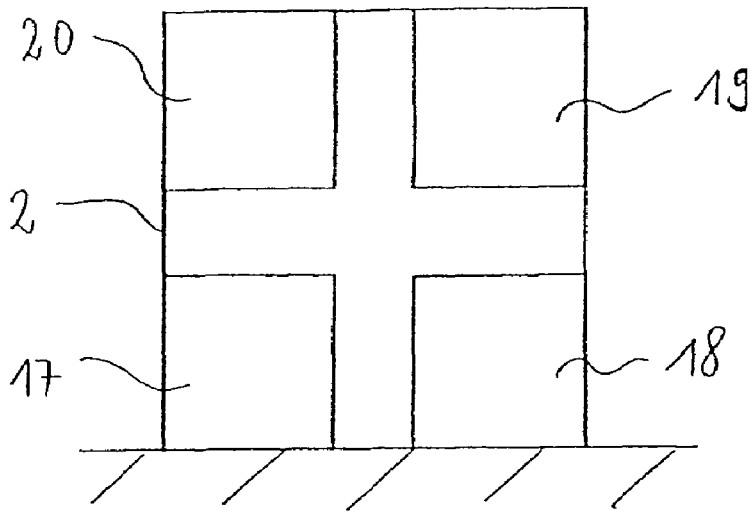
FIGS. 5*a* and 5*b* are schematic side views of shows the subunits in printing machines having different formats.
Figure 5B:
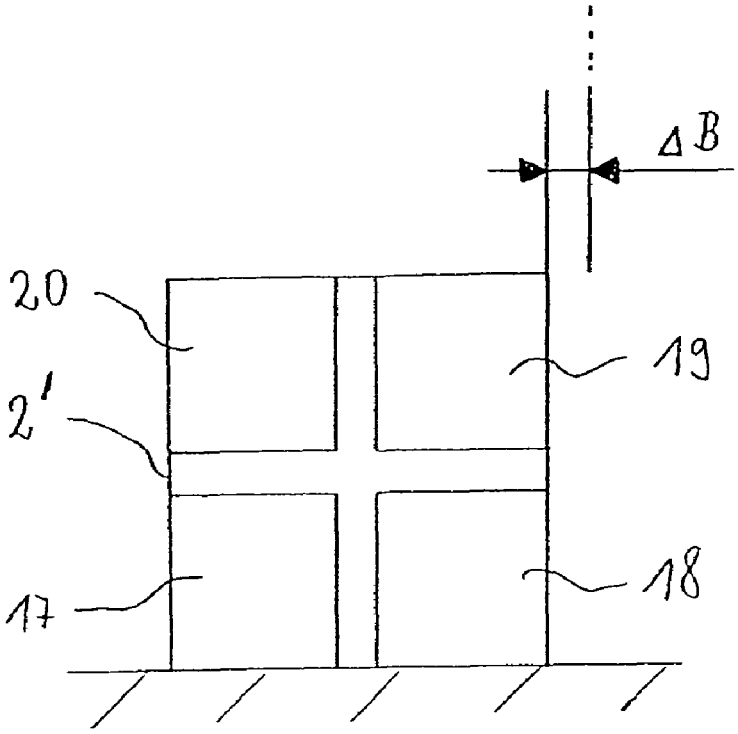

The subunits 17 to 20 are shown in FIGS. 5A and 5B are arranged in two different stands 2; 2'. The subunits 17 to 20 always have the same dimensions, it being possible for the stands 2; 2' to be different in their format or in their dimensions, the dimension and the format of the stands 2; 2' depending on the number and dimension of the printing cylinders used. While viewing the two illustrations shown in FIGS. 5A and 5B, it is possible to see the identically dimensioned subunits 17 to 20, but with the format difference between the stands 2; 2' represented by ΔB in FIG. 5B.

What is claimed is:

1. A printing unit of modular design for printing webs, comprising:

a stand having a drive side and an operating side;

at least one crossmember arranged at each of said sides of said stand, wherein said crossmembers are aligned horizontally or vertically;

printing cylinders mounted in the crossmembers and forming a structural unit of said printing unit with said crossmembers such that said structural unit comprising said printing cylinders mounted on said crossmembers is removably received in said stand of said printing unit; and subunits comprising auxiliary subassemblies necessary for the printing process, said subunits being replaceably arranged between said crossmember and said stand, and abutting a respective plate cylinder of said printing cylinders, said auxiliary subassemblies including damping and inking units.

2. A printing unit of modular design for printing webs, comprising:

a stand having a drive side and an operating side;

at least one crossmember arranged at each of said sides of said stand, wherein said crossmembers are aligned horizontally or vertically;

printing cylinders mounted in the crossmembers and forming a structural unit of said printing unit with said crossmembers such that said structural unit comprising said printing cylinders mounted on said crossmembers is removably received in said stand of said printing unit, wherein said printing cylinders comprise rubber cylinders arranged for printing on one or both sides of the web running therebetween and one of said rubber-covered cylinders is mounted in a swinging arm for pivoting, wherein said swinging arm is pivotable about an axis of a plate cylinder associated with said one of said rubber-covered cylinders.

* * * * *